US008111863B2

(12) United States Patent
Oliveira et al.

(10) Patent No.: US 8,111,863 B2
(45) Date of Patent: Feb. 7, 2012

(54) EARBUD ADAPTER

(75) Inventors: Robert J. Oliveira, Maplewood, MN (US); Michael T. Venem, Saint Paul, MN (US); Martin P. Babcock, White Bear Lake, MN (US)

(73) Assignee: Hearing Components, Inc., Oakdale, MN (US)

( * ) Notice: Subject to any disclaimer, the term of this patent is extended or adjusted under 35 U.S.C. 154(b) by 959 days.

(21) Appl. No.: 12/039,404

(22) Filed: Feb. 28, 2008

(65) Prior Publication Data

US 2008/0144878 A1 Jun. 19, 2008

Related U.S. Application Data

(63) Continuation of application No. 10/753,591, filed on Jan. 7, 2004, now Pat. No. 7,349,550.

(51) Int. Cl.
*H04R 25/00* (2006.01)

(52) U.S. Cl. ..... 381/381; 381/328

(58) Field of Classification Search ..... 181/129, 181/130; 381/309, 328, 329, 370, 371, 374, 381/376, 377, 378, 379, 380
See application file for complete search history.

(56) References Cited

U.S. PATENT DOCUMENTS

| | | | | |
|---|---|---|---|---|
| 2,188,591 | A | 1/1940 | Carlson | |
| 3,047,089 | A | 7/1962 | Zwislocki | |
| 3,732,382 | A | 5/1973 | DeWitt | |
| 4,965,838 | A | 10/1990 | Kamon et al. | |
| 4,981,194 | A | 1/1991 | Kamon et al. | |
| 5,048,092 | A | 9/1991 | Yamagishi | |
| 5,142,587 | A | 8/1992 | Kobayashi | |
| 5,544,253 | A | 8/1996 | Nagayoshi et al. | |
| 5,659,156 | A | 8/1997 | Mauney et al. | |
| 5,712,453 | A | 1/1998 | Bungardt et al. | |
| D391,576 | S | 3/1998 | Mullin et al. | |
| 5,920,636 | A | 7/1999 | Oliveira et al. | |
| 5,949,896 | A | 9/1999 | Nageno et al. | |
| 5,953,435 | A | 9/1999 | Mullin et al. | |
| 6,122,388 | A | 9/2000 | Feldman | |
| 6,310,961 | B1 | 10/2001 | Oliveira et al. | |
| 6,922,476 | B2 | 7/2005 | Nassimi | |
| 7,548,629 | B1 * | 6/2009 | Griffin | 381/380 |
| 2003/0173144 | A1 | 9/2003 | Werblud | |

FOREIGN PATENT DOCUMENTS

| | | | |
|---|---|---|---|
| GB | 2 355 129 | A | 4/2001 |
| JP | 58076300 | U | 5/1983 |
| JP | 04200000 | | 7/1992 |
| JP | 6081196 | U | 11/1994 |
| WO | 00/08893 | A1 | 2/2001 |
| WO | 01/87006 | A2 | 11/2001 |

* cited by examiner

*Primary Examiner* — Brian Ensey
(74) *Attorney, Agent, or Firm* — Seager, Tufte & Wickhem, LLC

(57) ABSTRACT

Adapters for use with sound devices and methods for making and using the same. In some embodiments, an example adapter may include an adapter body having a first side, a port or projection extending from the first side, and a second side. The second side is generally configured to be attachable to a sound device such as an earbud or earbud-type of headphone. The projection may include a sleeve attached thereto. The projection and sleeve are generally configured to at least in part extend into the ear canal of a user during use.

20 Claims, 10 Drawing Sheets

EARBUD ADAPTER

RELATED APPLICATIONS

This application is a continuation of U.S. application Ser. No. 10/753,591, filed Jan. 7, 2004, the entire disclosure of which is incorporated herein by reference.

FIELD OF THE INVENTION

The present invention pertains to sound devices and adapters or devices for use with sound devices. More particularly, the present invention pertains to adapters for use with earbud-type headphones that improve the comfort of the headphones, isolate the ear from extraneous sounds, and provide a number of other desirable features.

BACKGROUND OF THE INVENTION

Sound devices such as headphones are used extensively throughout the world. One style of headphones that is commonly used is referred to as an earbud or an earbud-type headphone. Earbuds are small speaker-like devices that are designed to fit within the external ear of a listener so that the user can listen to sound being transmitted from a sound source. Some examples of typical sound sources where earbuds may be used include personal and/or portable audio players (including radios, cassette players, compact disc players, portable mp3 players, etc.), portable DVD players, telephones (including wireless and cellular-type telephones), etc. When properly positioned in the ear, earbuds can provide the listener with acceptable sound transmission to the ear canal. However, due to person-to-person variations and variations in the environment in which the earbuds are used, fit may not be adequate and extraneous noise may make transmission inadequate.

A wide variety of headphones and earbuds have been developed as well as a number of adapters and prostheses attachable to these devices. In addition, a wide variety of methods for manufacturing headphones (including ear buds) and adapters have been developed. Among these known devices and methods, each has certain advantages and disadvantages. There is an ongoing need to provide alternative devices and methods for making these devices which improve sound transmission, isolate extraneous noise and provide improved comfort and fit.

BRIEF SUMMARY

The present invention relates to sound devices and adapters and/or prostheses for use with sound devices. In at least some embodiments, an example adapter may include an adapter body having a first side, a port or projection extending from the first side, and a second side. The second side is generally configured to be releasably attachable to an earbud or earbud-type headphone which would be positioned in the outer ear during use. The projection may include a sleeve attached thereto. The projection in one embodiment or the projection and sleeve in an alternative embodiment are generally configured to extend into the ear canal of a user. In preferred embodiments, a sleeve or foam cover is positioned over the sleeve to provide a contact surface which generally conforms to the users ear canal shape when at least a portion of the sleeve is positioned therein. Some of these and other features are described in more detail below.

DETAILED DESCRIPTION

Figure 1:
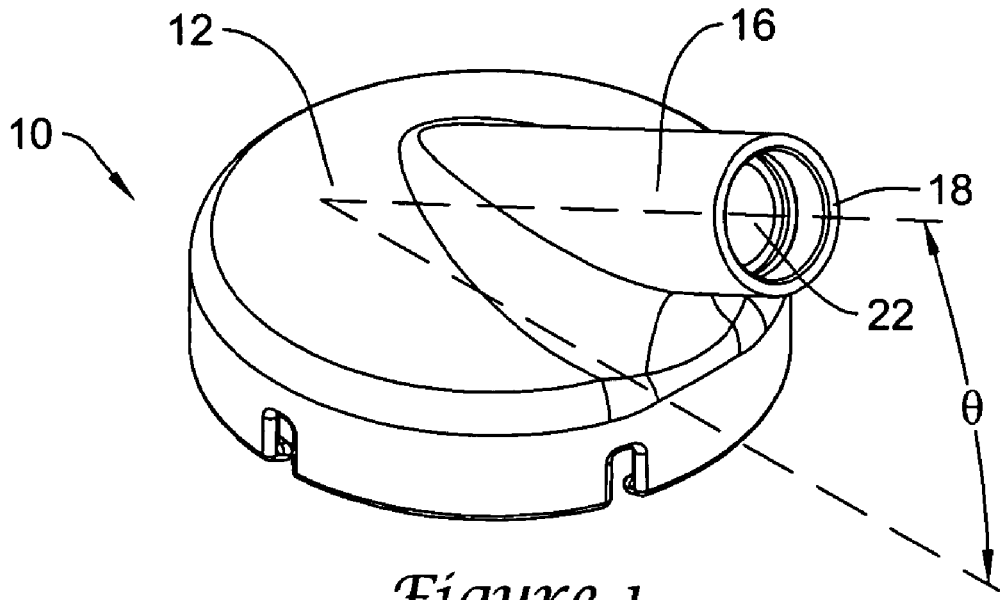
FIG. 1 is a perspective view of an example adapter.

The following description should be read with reference to the drawings wherein like reference numerals indicate like elements throughout the several views. The detailed description and drawings illustrate example embodiments of the claimed invention.

Figure 2:
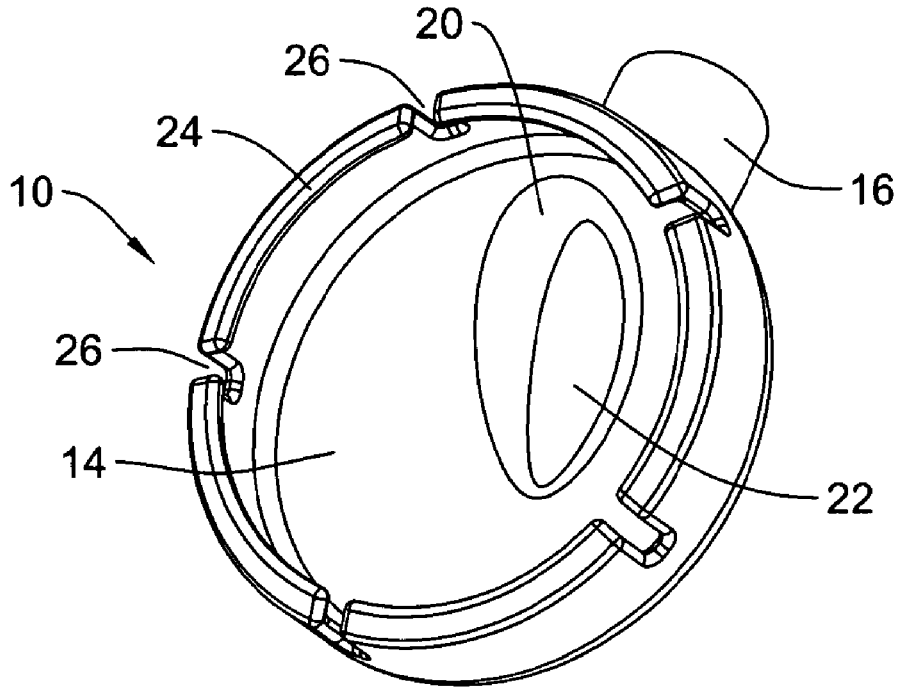
FIG. 2 is an alternative perspective view of the example adapter depicted in FIG. 1.

FIGS. 1 and 2 are perspective views of an example adapter body 10 for use with an earbud or an earbud-type sound device or headphone. Adapter 10 includes a top side or portion 12, as best seen in FIG. 1, and a bottom side or portion 14, as best seen in FIG. 2. A projection or port 16 extends from top side 12. A port opening 18 is defined in projection 16. In some embodiments, opening 18 is at the distal terminus of projection 16. In other embodiments, opening 18 can be disposed at other locations along projection 16. A second opening 20 is defined in adapter body 10 that is disposed on bottom side 14. A sound conduit 22 is defined in adapter body 10 that extends between opening 18 and opening 20. Sound conduit 22 generally allows sound to pass from a sound device (to which adapter body 10 is attached), into and through opening 20, through projection 16, through and out from opening 18, and into the ear canal of a user.

Adapter body 10 is configured to be attachable to an earbud or earbud-type sound device. An earbud or earbud-type device is one that normally rests within the outer ear during use without extending into the ear canal. Preferably, adapter body 10 is configured for being detachably connectable to a sound device. This feature allows a user to freely attach and detach adapter body 10 as desired. However, the adapter body 10 is held in place with sufficient force to retain its position on the sound device during use. In addition, the user may discard adapter body 10 after use, if desired, and replace it with a new one for subsequent uses. The earbud or earbud-type sound device may be a part of a cell phone headset, CD player or any other sound transmission device. It may include one or more ear buds.

The materials used to manufacture adapter body 10 may vary. In some embodiments, adapter body 10 is made from a polymer. Because a number of polymers are relatively inexpensive, constructing adapter body 10 from a polymer may desirably impact the manufacturing costs. In addition, because of the relatively low manufacturing costs that are contemplated, adapter body 10 may be inexpensive for the consumer and disposable. Some examples of suitable polymers may include ethylene tetrafluoroethylene (ETFE), fluorinated ethylene propylene (FEP), polyoxymethylene (POM), polybutylene terephthalate (PBT), polyether block ester, polyurethane, polypropylene (PP), polyvinylchloride (PVC), polyether-ester (for example, a polyether-ester elastomer such as ARNITEL® available from DSM Engineering Plastics), polyester (for example a polyester elastomer such as HYTREL® available from DuPont), polyamide (for example, DURETHAN® available from Bayer or CRISTAMID® available from ElfAtochem), elastomeric polyamides, block polyamide/ethers, polyether block amide (PEBA, for example, available under the trade name PEBAX®), silicones, polyethylene (PE), Marlex high-density polyethylene, Marlex low-density polyethylene, linear low density polyethylene (for example, REXELL®), polyethylene terephthalate (PET), polyetheretherketone (PEEK), polyimide (PI), polyetherimide (PEI), polyphenylene sulfide (PPS), polyphenylene oxide (PPO), polysulfone, nylon, perfluoro(propyl vinyl ether) (PFA), other suitable materials, or mixtures, combinations, copolymers thereof, polymer/metal composites, and the like.

As suggested above, bottom portion 14 is configured so that adapter body 10 can releasably attach to a sound device. In some embodiments, bottom 14 can include a ridge or rim 24 that is adapted to fit over and generally be disposed along the perimeter of the earbud or earbud-type sound transmitting device. It can be seen in FIG. 2 that rim 24 may be generally circular in shape so as to correspond to the generally circular and/or conical shape of the sound device. However, other shapes are contemplated, depending on the shape of the sound device. For example, rim 24 could be oval, squared, polygonal, etc. so as to improve the compatibility, attachability, and detachability of adapter body 10 to a variety of sound devices. In addition, one or more notches 26 may be defined in rim 24, which can allow rim 24 to adjust to somewhat differently sized or shaped sound devices and allow adapter body 10 to more easily attach and detach from the sound device while providing sufficient frictional engagement. This feature may allow a consumer to use one particular adapter body 10 embodiment with a number of differently sized or shaped sound devices.

Projection or port 16 is generally configured for extending into the ear canal of a user during use. In order for projection 16 to be properly positioned and/or seated in the ear canal, projection 16 preferably extends at a selected angle θ from the plane defined by top portion 12, as shown in phantom in FIG. 1. By being disposed at a selected angle, the design of adapter body 10 allows top portion 12 to rest in the outer ear while still allowing projection 16 to extend into the external auditory meatus (i.e., the auditory or ear canal). In one preferred embodiment, the angle θ is between about 0 degrees to about 45 degrees. In another preferred embodiment, projection 16 is disposed at an angle of about 15±10 degrees. These ranges assume that adapter body 10 is positioned in the ear in a manner so that the contours of top portion 12 are substantially parallel to the contours of the concha (i.e., the bowl of the ear). It can be appreciated that angle θ can vary outside these ranges, particularly if adapter body 10 is positioned in the ear in a manner so that top portion 12 is not substantially parallel to the concha. For example, if the adapter body 10 is disposed at another position in the ear, partially or completely behind the ear, or at some other location, a number of differing angles θ are contemplated. In addition, the material composition and design of adapter body 10 may allow angle θ to be variable for any particular adapter body 10. For example, adapter body 10 may be configured so that angle θ can bend or flex so that adapter body 10 can fit more comfortably in a variety of different users' ears. According to this embodiment, angle θ may vary within any given adapter body 10.

Figure 3:
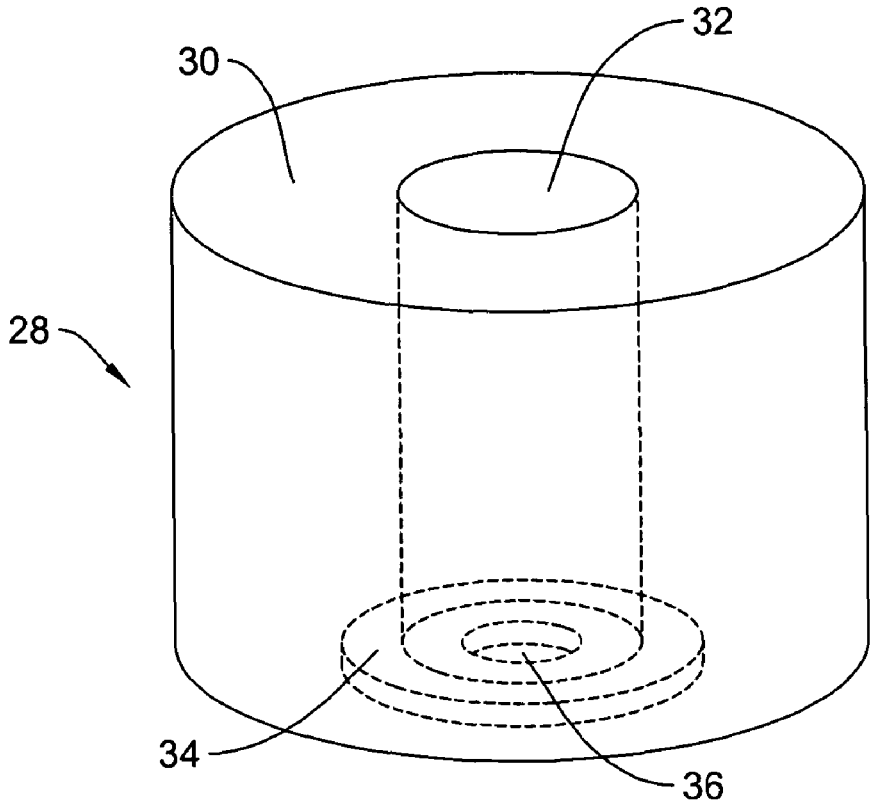
FIG. 3 is a side view of an example sleeve for use with an adapter.
Figure 4:
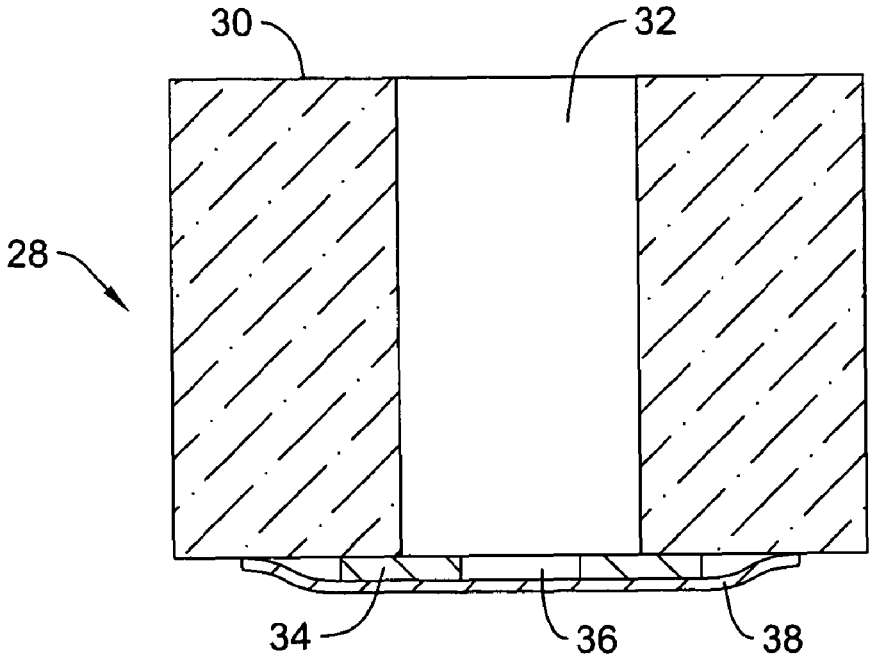
FIG. 4 is a cross-sectional view of the sleeve depicted in FIG. 3.

In preferred embodiments, a sleeve or foam cover 28 may be coupled to projection 16. Sleeve 28 may be coupled to projection 16 in any number of suitable manners such as with an adhesive. Alternatively, sleeve 28 may be attached using a coupling member as described in more detail below. A side view of an example sleeve 28 is depicted in FIG. 3, and a cross-sectional view of sleeve 28 is shown in FIG. 4. In these Figures, it can be seen that sleeve 28 may be generally cylindrical in shape. Additionally, sleeve 28 may include a first surface 30 and an axial hole 32 in first surface 30 that extends into sleeve 28. In some embodiments, opening 32 extends into only a portion of sleeve 28. In other embodiments, opening 32 extends all the way through sleeve 28. Some of the features and characteristics of a suitable sleeve 28 can be found in U.S. Pat. No. 5,920,636, the disclosure of which is incorporated herein by reference.

Sleeve 28 may also include a number of other structural components. For example, a lock ring 34 may be disposed at one end of sleeve 28 and attached to sleeve 28 by any suitable means. The mechanism for attaching lock ring 34 to sleeve 28 may vary. For example, lock ring 34 may be mechanically attached, adhesively bonded, thermally bonded, and the like, or otherwise attached in any suitable manner. Lock ring 34 may include a hole 36 that may be axially aligned with hole 32. In some embodiments, lock ring 34 partially covers hole 36 so that hole 36 of lock ring 34 is smaller than axial hole 32 of sleeve 28. In other embodiments, hole 36 is about the same size or slightly larger than axial hole 32. Lock ring 34 may be made from a stiffer, yet deformable material such as a stiffer foam, polyethylene, polyurethane, polyethylene terephthalate, or any other suitable material including those disclosed herein. The use of lock ring 34, and variants thereof, is described in more detail below. Sleeve 28 may also include a thin layer 38 of a sound-transmitting material or scrim (e.g., preferably a reticulated open cell foam) that helps prevent detritus or cerumen from the ear canal from entering a sound delivery tube of a sound device on which sleeve 28 may be mounted.

Sleeve 28 can be of many different types of materials such as a polymer or foam. Some example polymers are listed above. A number of different types of foams exist, which may be suitable for some embodiments. For example, sleeve 28 could be made of a sound attenuating slow recovery foam. This type of foam may allow the user to compress sleeve 28 with his/her fingers before it is placed in the ear canal, after which it recovers its shape sufficiently so that its periphery conforms to the inner surface of the ear canal. This feature can improve the fit and comfort of adapter body 10 (and sleeve 28) in the ear canal. In addition, this type of foam can substantially block sounds from entering the ear canal other than sounds transmitted from the sound device that pass through adapter body 10. This feature may be desirable because blocking extraneous sound "isolates" the ear in which sleeve 28 is disposed from these other sounds.

It is believed that isolating an ear from other sounds (i.e., sounds not originating from the sound device) allows the user to better process sound coming from the sound device, even when the device is only in one ear with the other ear receiving the extraneous sounds. This allows the user to better distinguish the sounds from the sound device from other sounds that could be distracting. This feature may be particularly useful when the sound device is an earbud connected to a telephone because the user would be able to adequately hear and distinguish voices from the telephone from other sounds or voices that might be present in the area. This feature also reduces the likelihood that sounds originating from the sound device would be confused with extraneous sounds, even when the user's other ear does not have any sound device disposed therein. Moreover, by reducing the amount of unwanted sound that enters the ear, a lesser degree of energy can be delivered to the eardrum for the same level of sound perception and intelligibility. This can protect the eardrum from damage that could be caused by exposure to greater amounts of energy or otherwise help preserve or enhance the long-term health of the ear.

Where it is desirable to have sounds enter the ear both through the sound device and sleeve 28, sleeve 28 can be of a more sound transmissive foam such as open cell foam or a reticulated open cell foam selected for the amount of sound transmission desired. Typically, such open cell foams are sufficiently compressible so that the periphery will conform to the inner surface of the ear canal as sleeve 28 is pushed into it. It can be appreciated that the use of a number of other types of foams and similar materials are contemplated. In addition, a plethora of other suitable materials are contemplated, including silicone rubber.

The following examples of dimensions for sleeve 28 are provided for illustrative purposes and are not intended to be limiting. In some embodiments, sleeve 28 can have a diameter of about 0.35 to about 0.65 inches and an axial length between its surfaces of about 0.15 to about 0.65 inches. Hole 32 may have a diameter of about 0.08 to about 0.19 inches. Lock ring 34 can be of a polymeric material about 0.005 to about 0.025 inches in thickness. Lock ring 34 can have an outer diameter of about 0.15 to about 0.30 inches. Hole 36 in lock ring 34 may have a diameter of about 0.05 to about 0.15 inches. The diameter of hole 36 can provide for a clearance fit of about 0.005±0.003 inches to an interference fit of about 0.020±0.010 inches between the lock ring 34 and the bottom of a grooved coupling (e.g., a groove defined in projection 16 or in a coupling member such as the one described below), that fit being selected to provide the degree of engagement desired between sleeve 28 and adapter body 10. Such interference fits will cause a portion of lock ring 34 to remain in a slightly frusta-conical shape after engagement around projection 16, which insures firm engagement therebetween.

Figure 5:
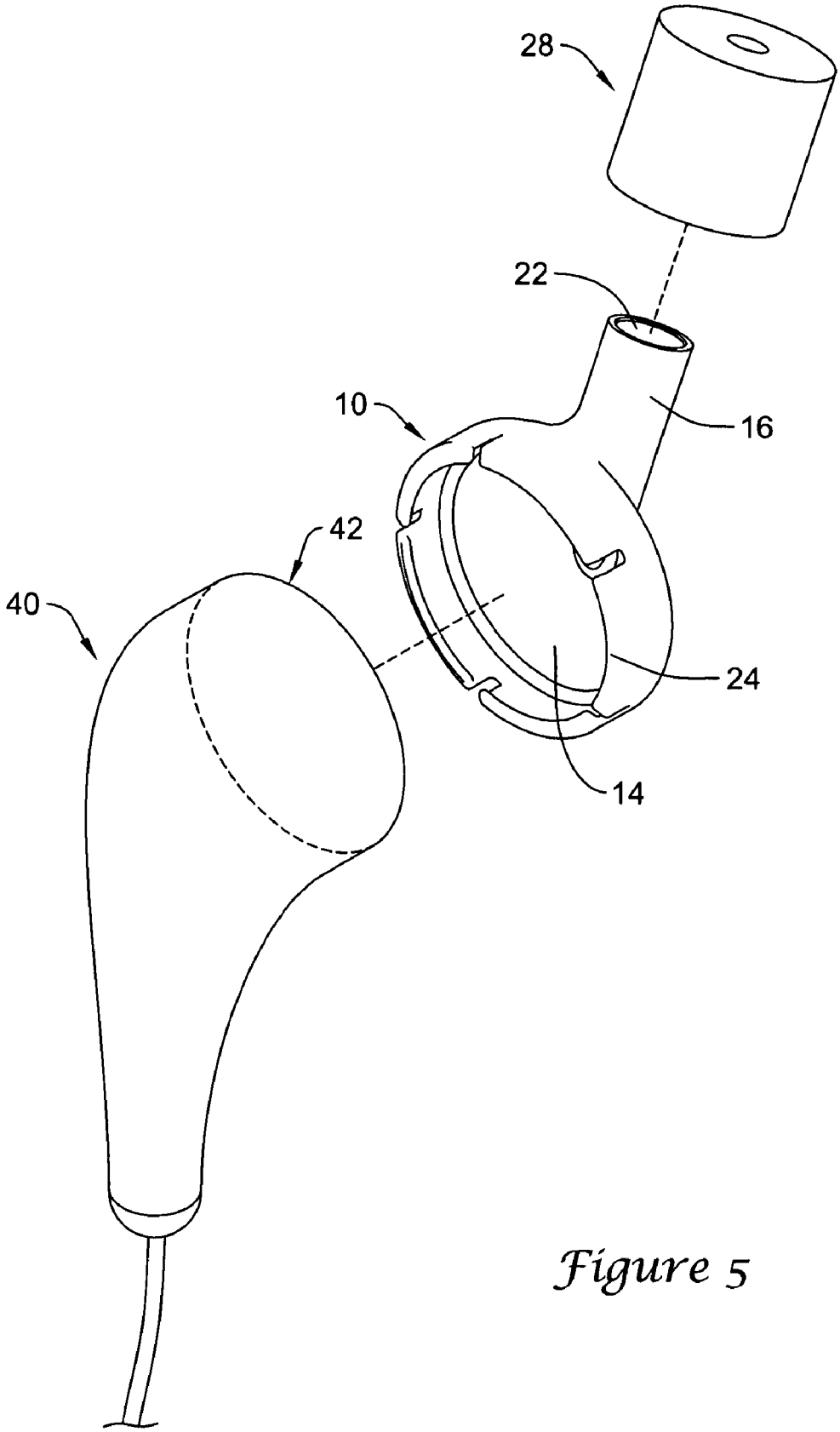
FIG. 5 is an exploded view of an example sound device, adapter, and sleeve.
Figure 6:
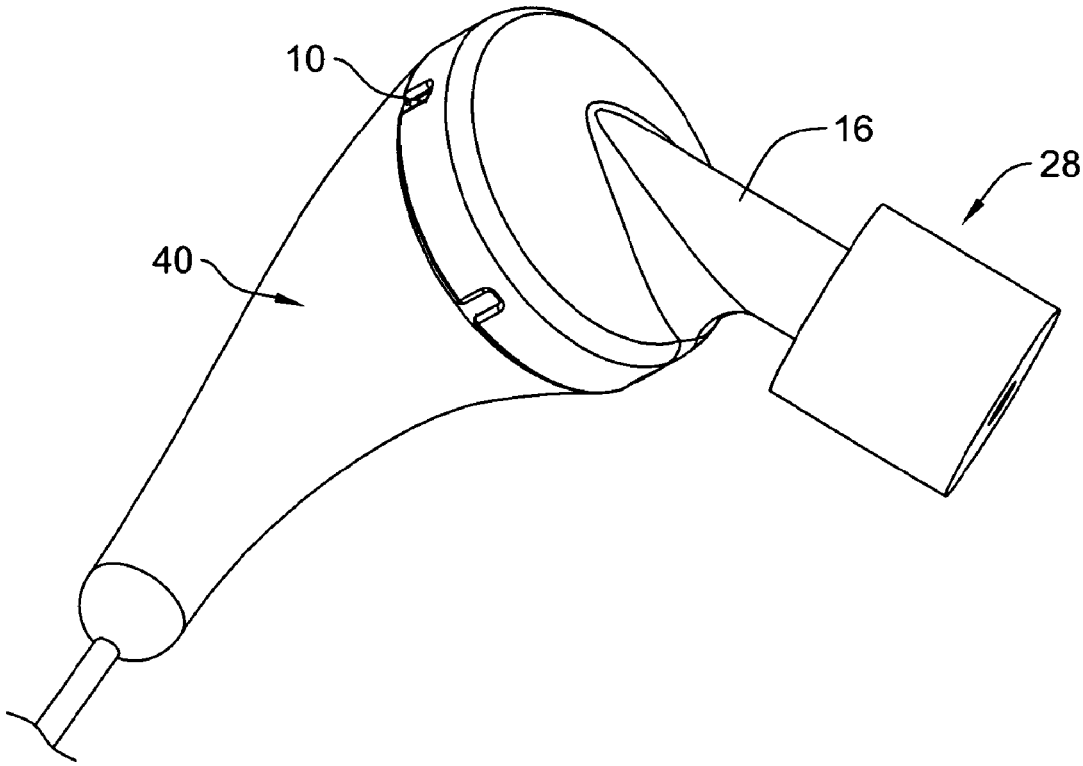
FIG. 6 is a perspective view showing the connection of the sound device, adapter, and sleeve.

An exploded view of an earbud-type sound device 40 (depicted as an earbud), adapter body 10, and sleeve 28 is depicted in FIG. 5. Here the relationships of the relevant devices can be more clearly seen. For example, rim 24 of adapter body 10 can be disposed over earbud 40 so that speaker face 42 is seated adjacent bottom portion 14. Sleeve 28 can be disposed over a portion of projection 16. Sound emitted from earbud 40 can pass through sound hole 22 and, ultimately, into the ear canal of a user. A perspective view of earbud 40, adapter body 10, and sleeve 28 as connected is shown in FIG. 6. The adapter body 10 is rotated to a position which provides the best fit for the particular user when the port 16 extends into the ear canal and the earbud rests in the outer ear. This preferred orientation is generally depicted in FIG. 6.

Figure 7:
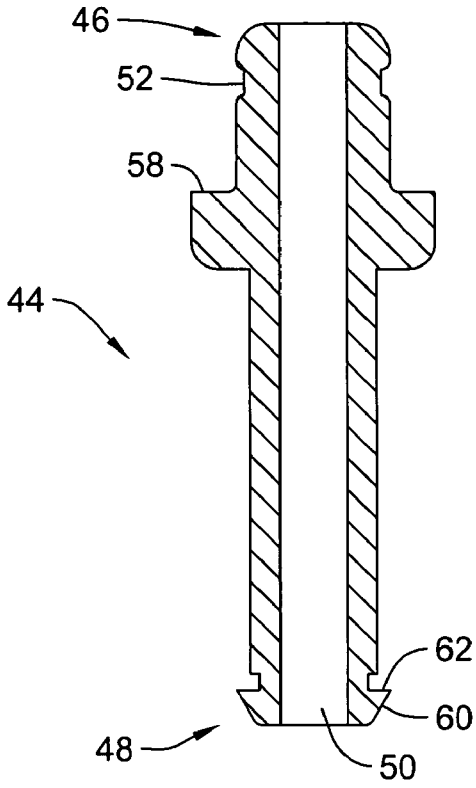
FIG. 7 is a cross-sectional view of an example coupling member.
Figure 8:
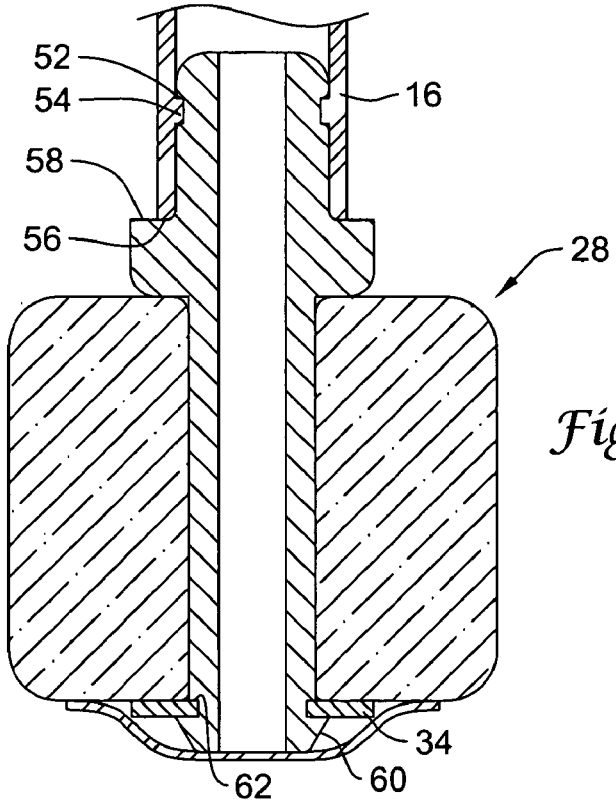
FIG. 8 is a cross-sectional view of the coupling member of FIG. 7 attached to a sleeve.

As described above, sleeve 28 may be coupled to projection 16 with an adhesive or any other suitable means. Alternatively, sleeve 28 may be attached to projection 16 with a coupling member 44. A cross-sectional view of an example coupling member 44 is shown in FIG. 7. Coupling member 44 may include a first end region 46, a second end region 48, and a sound channel 50 extending therethrough in communication with sound conduit 22 when positioned on or integrally formed with projection 16. First end region 46 may be configured for being attached to projection 16. For example, a groove or notch 52 may be defined adjacent first end region 46 that is adapted to engage a corresponding protrusion 54 defined in projection 16 as seen in FIG. 8. Groove 52 and protrusion 54 can interlock when first end 46 is disposed into projection 16. Alternatively, first end region 46 may simply be disposed into projection 16 (regardless of whether or not projection 16 includes protrusion 54) and secured with an adhesive, another type of mechanical bond, a friction fit bond, a thermal bond, and the like, or any other suitable way. When coupled, the distal end 56 of projection 16 may be seated against or adjacent a shelf region 58 of coupling member 54.

Second end region 48 is configured to releasably attach to sleeve 28. For example, second end region 48 may include a sloped portion 60 and a notch 62 that is configured to engage lock ring 34. According to this embodiment, second end region 48 can be advanced through hole 32 of sleeve 28 so that sloped portion 60 comes into contact with lock ring 34. Further advancing second end region 48 results in sloped portion 60 passing through hole 36 in lock ring 34 so that, ultimately, lock ring 34 "snaps" into position and becomes disposed in notch 62. This can result in a stable interference type mechanical bond between sleeve 28 and coupling member 44.

Figure 9:
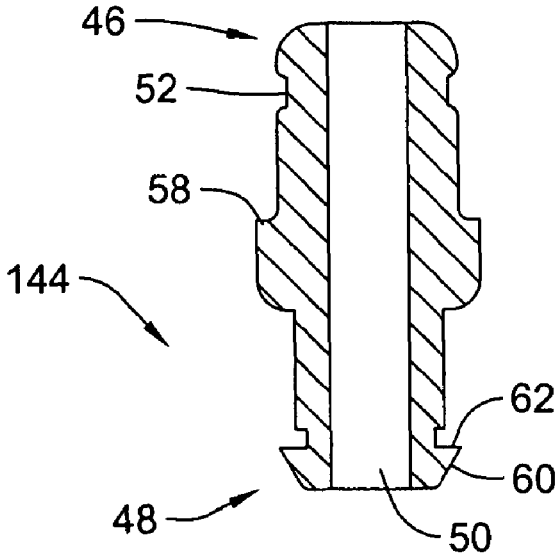
FIG. 9 is a cross-sectional view of another example coupling member.
Figure 10:
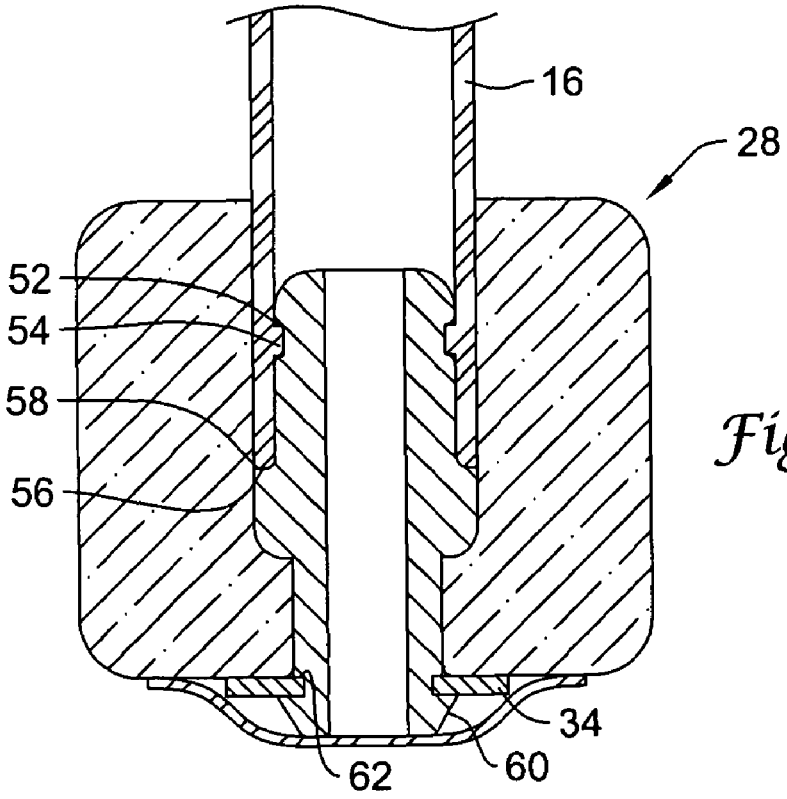
FIG. 10 is a cross-sectional view of the coupling member of FIG. 9 attached to a sleeve.

FIG. 9 is a cross-sectional view of another example coupling member 144 that is shorter but otherwise similar to coupling member 44. First end region 46 of coupling 144 may be configured for being attached to projection 16, for example, via engagement of notch 52 with protrusion 54 or by disposing first end region 46 into projection 16 as described above. Because coupling member 144 is shorter than coupling member 44, first end region 46 terminates or is otherwise disposed within sleeve 28 (i.e., within hole 32 of sleeve 28) when it is engaged with lock ring 34. Accordingly, distal end 56 of projection 16 is also disposed within sleeve 28 when projection 16 is engaged with coupling member 144 and sleeve 28 as shown in FIG. 10. The relationships between the other components of coupling member 144 with sleeve 28 may be substantially similar to the relationships described above in regard to coupling member 44.

In some embodiments, coupling member 44 may be "pre-attached" to or "formed integral" with adapter body 10. This feature allows a user to simply attach sleeve 28 to projection 16 as needed and use adapter body 10 and sleeve 28 with the earbud or other sound device. Alternatively, a kit may be provided that includes adapter body 10, coupling member 44, and sleeve 28. According to this embodiment, the user may attach coupling member 44 to projection 16 (e.g., as described above) and attach coupling member 44 to sleeve 28. Either way, adapter body 10 (which may have sleeve 28 attached thereto) can be disposed over the ear bud, and sleeve 28 can be disposed in the ear canal. Alternatively, adapter body 10 can be provided with sleeve 28 permanently attached thereto. As previously stated, this entire assembly would then be disposable by the user.

Figure 11:
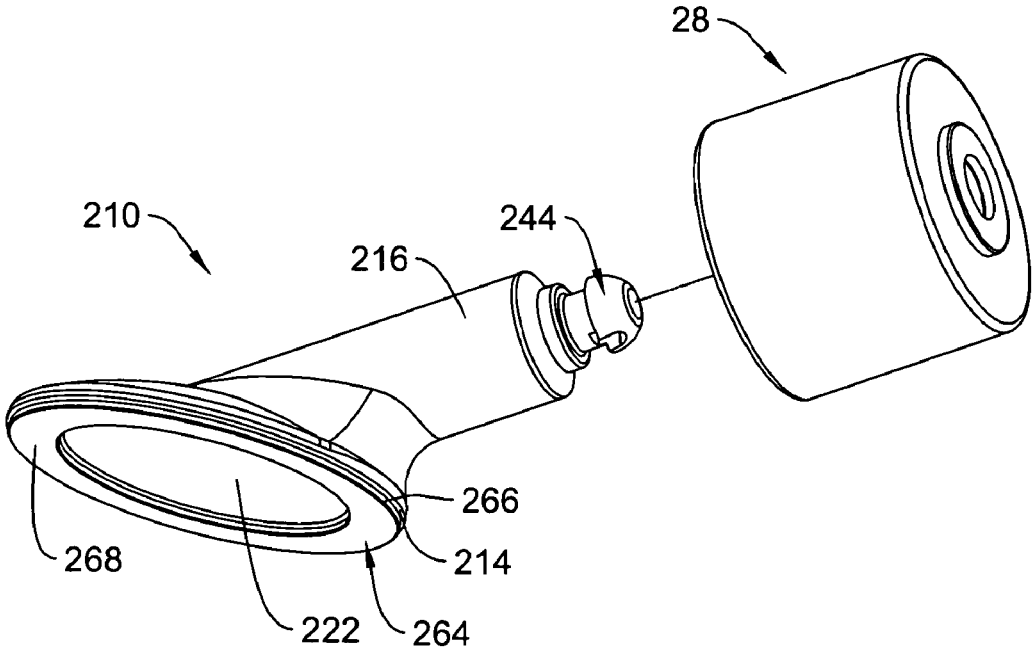
FIG. 11 is an exploded view of another example adapter body, coupling member, and sleeve.

FIG. 11 is an exploded view of another adapter body 210 for use with coupling member 244 (which may be similar to any of the coupling members disclosed herein) and sleeve 28. Adapter body 210 is similar to adapter body 10 except that it includes a connector 264 along bottom surface 214 instead of a rim (e.g., rim 24 as best seen in FIG. 2). Connector 264 can vary. In some embodiments, connector 264 includes an adhesive disk or ring 266 having a peel-away covering 268 disposed over it. Adhesive disk 266 may include a pressure-sensitive or other type of adhesive layer that is attached to bottom surface 214. Adhesive disk 266 may or may not include a foam base or linker that is used to connect adhesive disk 266 to bottom surface 214. To use connector 264, a user may simply peel away covering 268 in order to expose adhesive disk 266 and then attach adapter body 210 to a sound device by pressing the two objects together with his or her fingers. In alternative embodiments, connector 264 may simply include a foam base having an adhesive surface or another suitable type of attachment means for attaching adapter body 210 to a sound device.

The remaining structures shown in FIG. 11 may be substantially similar to the analogous structures depicted in the other figures. For example, adapter body 210 may include projection 216 that is similarly configured to any of the projections described herein. Coupling member 244 may be attached to projection 216 and may be adapted to attach adapter body 210 to sleeve 28. As described above, coupling member 244 may be a distinct structural component that is attachable to sleeve 28 and projection 216, or it may be integral with projection 216 and/or sleeve 28.

Figure 12:
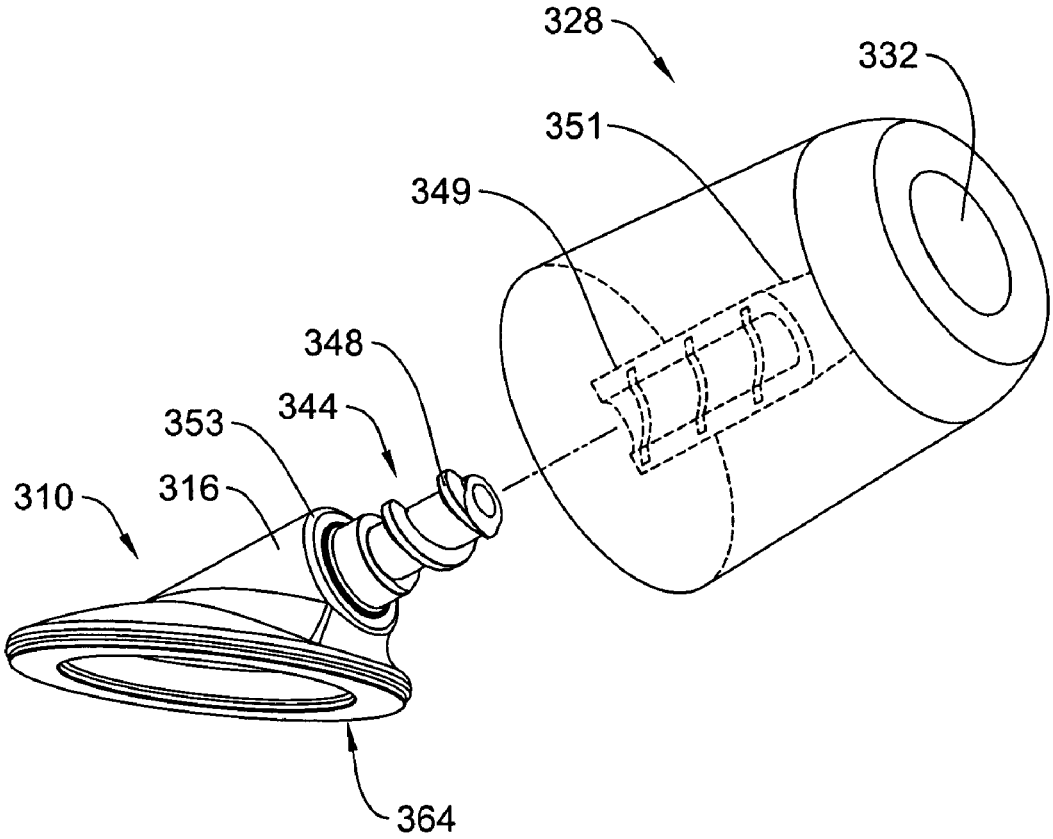
FIG. 12 is an exploded view of still another example adapter body, coupling member, and sleeve.

FIG. 12 depicts another example adapter body 310, coupling member 344, and sleeve 328. Adapter body 310 is substantially similar to adapter body 210 and may include projection 316 and connector 364. Coupling member 344 is similar to other coupling members described herein except that second end region 348 includes a thread. As described above, coupling member 344 may be a distinct structural component that is attachable to sleeve 328 or it may be integral with projection 316 and/or sleeve 328.

Threaded second end region 348 of coupling member 344 is configured to threadably engage sleeve 328. In some embodiments, sleeve 328 includes a threaded nut portion 349 (shown in phantom) disposed in or adjacent the hole 332 of sleeve 328. Accordingly, threaded second end region 348 can mate with threaded nut portion 349 so as to secure coupling member 344 (and, thus, adapter body 310) with sleeve 328. When coupled, sleeve 328 may abut a flange portion 353 of projection 316. Flange portion 353 provides a stopping point that will stop sleeve 328 from being screwed onto adapter body 310 any further than desired. Within sleeve 328 and extending from threaded nut portion 349 may be a flexible tapered portion 351. Flexible portion 351 allows sleeve 328 to be flexible so that it can conform to the shape of a user's ear canal while connected to adapter body 310. Moreover, this flexibility allows sleeve 328 to fit comfortably yet securely in the user's ear. Further suitable sleeves and coupling members that are similar in structure and function to sleeve 328 and coupling member 344 can be found in U.S. Pat. No. 5,002,151, the disclosure of which is incorporated herein by reference.

Figure 13:
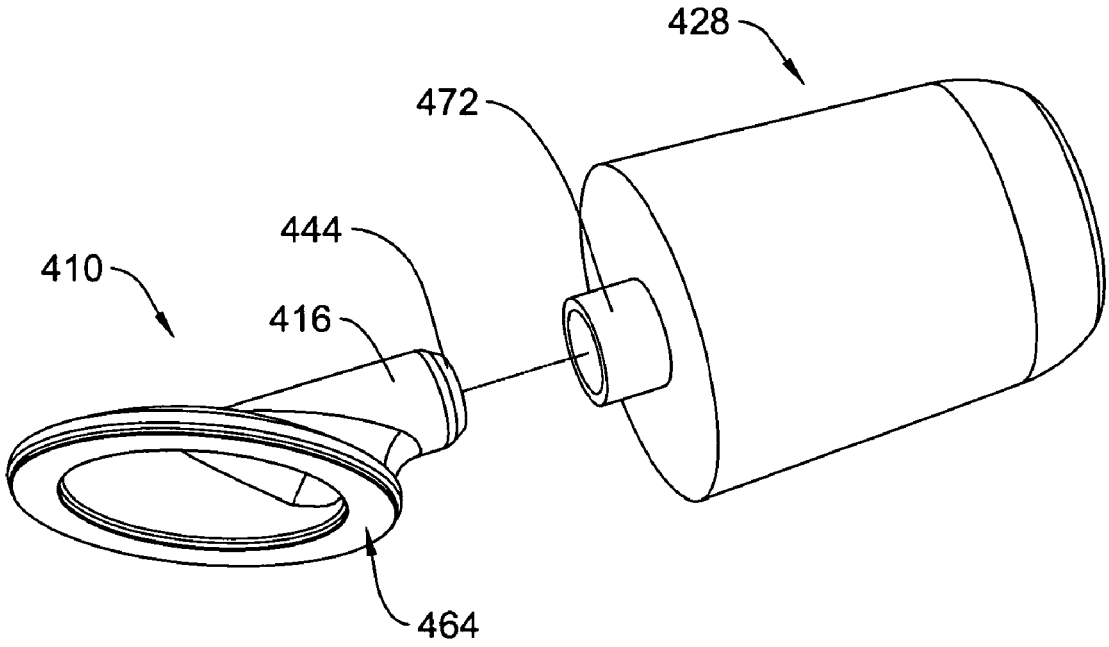
FIG. 13 is an exploded view of still another example adapter body, coupling member, and sleeve.

FIG. 13 depicts another example adapter body 410, coupling member 444, and sleeve 428. Adapter body 410 is substantially similar to adapter body 310 and may include projection 416 and connector 464. Coupling member 444 may comprise a sloped ridge configured for an interference fit with sleeve 428, for example, at a connector region 472 disposed on sleeve 428. According to this embodiment, a user may attach sleeve 428 to adapter body 410 by simply pushing sleeve 428 into contact with coupling member 444 in a manner that engages these structures and holds them together due to the interference-type connection. Aside from connector region 472, sleeve 428 may be similar to any of the other sleeves described herein. As described above, coupling member 444 may be a distinct structural component that is attachable to sleeve 428 or it may be integral with projection 416 and/or sleeve 428.

Figure 14:
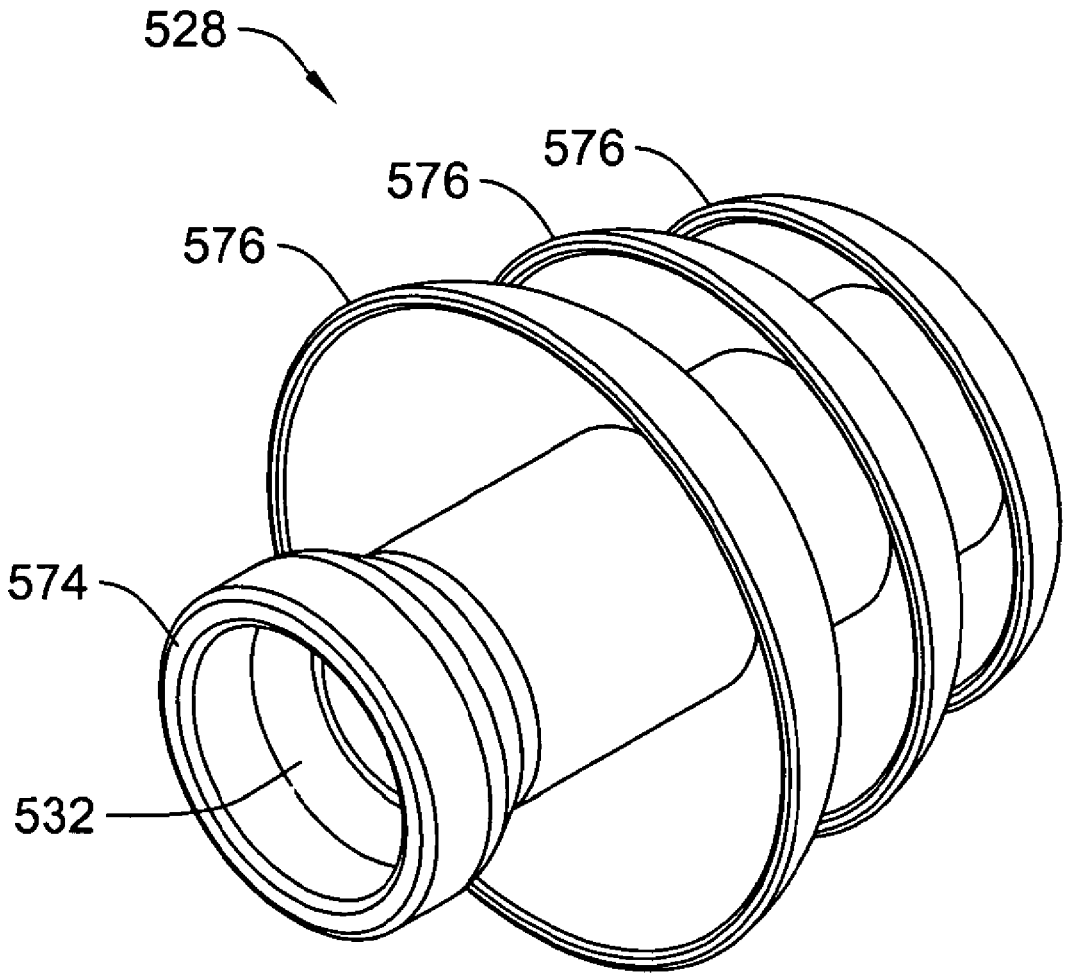
FIG. 14 is a perspective view of another example sleeve.

FIG. 14 is a perspective view of another example sleeve 528 for use with any of the adapter bodies and coupling members disclosed herein. Sleeve 528 may include an axial hole or sound conduit 532, which is similar to hole 32 described above in relation to sleeve 28. Sleeve 528 may also include a mouth region 574 for connecting sleeve 528 to an adapter body or coupling member. For example, sleeve 528 may be attached to a coupling member or adapter body by disposing mouth 574 about the relevant structure. In addition, sleeve 528 may include one or more flaps or flanges 576. In some embodiments, sleeve 528 may include one, two, three, four, five, or more flanges. Flanges 576 may be configured so that they can bend inward or fold over when disposed in the ear canal of a user. For example, one flange 576 may fold over an adjacent flange 576. This feature may provide greater comfort for the user as well as the other sound-isolating and other desirable features described above. Sleeve 528 may be made from any suitable material. For example, sleeve 528 may be made from silicone rubber or any of the materials disclosed herein.

It should be understood that this disclosure is, in many respects, only illustrative. Changes may be made in details, particularly in matters of shape, size, and arrangement of steps without exceeding the scope of the invention. The invention's scope is, of course, defined in the language in which the appended claims are expressed.

What is claimed is:

1. An adapter for use with an earbud-type sound device, the adapter comprising:

an adapter body having a top portion, an opposing bottom portion which is configured to be attached to an earbud-type sound device, and a projection extending from the top portion including a sound conduit for directing sound through the projection;

the bottom portion of the adapter body including a rim adapted to fit over and generally extend around the perimeter of the earbud-type sound device, wherein the rim of the adapter body is divided into a plurality of discontinuous segments.

2. The adapter of claim 1, wherein each of the plurality of discontinuous segments is an arcuate discontinuous segment.

3. The adapter of claim 2, wherein each of the plurality of discontinuous segments includes a radially inward extending ridge of material.

4. The adapter of claim 3, wherein the ridge of material is configured to form an interference fit with the earbud-type sound device.

5. The adapter of claim 1, wherein the rim is generally circumferential and the plurality of discontinuous segments are uniformly arranged around a circumference of the rim.

6. The adapter of claim 1, wherein the top portion of the adapter body includes an outer surface and an inner surface, wherein the projection extends from the outer surface, and wherein the inner surface faces a speaker face of the earbud-type sound device;

wherein the plurality of discontinuous segments extend away from the projection.

7. An adapter for use with an earbud-type sound device, the adapter comprising:

an adapter body having a top portion, an opposing bottom portion which is configured to be attached to an earbud-type sound device, and a projection extending from the top portion including a sound conduit for directing sound through the projection;

the bottom portion of the adapter body including a circumferential rim of material including a plurality of notches defined therein, dividing the rim into a plurality of discontinuous arcuate segments.

8. The adapter of claim 7, wherein the plurality of notches include a first notch and a second notch, wherein the first notch is located less than 90 degrees from the second notch.

9. The adapter of claim 7, wherein the plurality of notches include a first notch and a second notch, wherein the first notch is located greater than 90 degrees from the second notch.

10. The adapter of claim 7, wherein the rim is an annular rim which can be divided into four quadrants, moving in a clockwise direction: a first quadrant, a second quadrant, a third quadrant, and a fourth quadrant;

wherein a first notch is located in the first quadrant and a second notch is located in the second quadrant.

11. The adapter of claim 10, wherein an imaginary boundary is defined between the first quadrant and the second quadrant, wherein the projection extends radially outward from the adapter body in the direction of the boundary between the first quadrant and the second quadrant.

12. An adapter configured to be detachably coupled to an earbud-type sound device, the adapter comprising:

a dome-shaped wall configured to be disposed adjacent a speaker face of the earbud-type sound device;

a projection extending from the dome-shaped wall, the projection including a sound conduit for directing sound through the projection;

a sleeve coupled to the projection, the sleeve configured to be inserted into the ear canal of a user;

a plurality of discontinuous segments extending from the dome-shaped wall, the plurality of discontinuous segments uniformly spaced around the perimeter of the dome-shaped wall;

wherein the plurality of discontinuous segments are configured to fit over and generally extend around the perimeter of the earbud-type sound device.

13. The adapter of claim 12, wherein each of the plurality of discontinuous segments is an arcuate discontinuous segment.

14. The adapter of claim 13, wherein each of the plurality of discontinuous segments includes a radially inward extending ridge of material.

15. The adapter of claim 14, wherein the ridge of material is configured to form an interference fit with the earbud-type sound device.

16. The adapter of claim 12, wherein the sleeve is removably coupled to the projection.

17. The adapter of claim 12, wherein the projection includes an annular ridge, and the sleeve is positioned over the annular ridge of the projection to couple the sleeve to the projection.

18. The adapter of claim 12, wherein the adapter includes three discontinuous segments.

19. The adapter of claim 12, wherein the adapter includes four discontinuous segments.

20. The adapter of claim 12, wherein the sleeve is formed of a compressible foam material.

* * * * *